US008246032B2

(12) United States Patent
Nakajima

(10) Patent No.: US 8,246,032 B2
(45) Date of Patent: Aug. 21, 2012

(54) POST-PROCESSING APPARATUS, SHEET EJECTION METHOD THEREOF AND IMAGE FORMING SYSTEM

(75) Inventor: Hirofumi Nakajima, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 177 days.

(21) Appl. No.: 12/764,295

(22) Filed: Apr. 21, 2010

(65) Prior Publication Data

US 2010/0270725 A1 Oct. 28, 2010

(30) Foreign Application Priority Data

Apr. 27, 2009 (JP) ..... 2009-107530

(51) Int. Cl.
*B65H 31/32* (2006.01)

(52) U.S. Cl. ..... 270/58.01; 270/58.14; 270/58.18; 271/3.03

(58) Field of Classification Search ..... 270/58.01, 270/58.14, 58.18; 271/3.03, 3.17, 3.18, 319
See application file for complete search history.

(56) References Cited

U.S. PATENT DOCUMENTS 6,161,828 A * 12/2000 Sussmeier ..... 270/59
6,199,850 B1 * 3/2001 Seki ..... 270/58.07
6,273,419 B1 * 8/2001 Allen et al. ..... 271/303
6,439,562 B1 * 8/2002 Cote et al. ..... 270/52.17
6,568,676 B2 * 5/2003 Manna et al. ..... 271/303
7,413,178 B2 * 8/2008 Fujii et al. ..... 270/58.11
7,540,482 B2 * 6/2009 Fujii et al. ..... 270/58.1
7,584,948 B2 * 9/2009 Fujii et al. ..... 270/58.11
7,780,158 B2 * 8/2010 Fujii et al. ..... 270/58.1
7,992,854 B2 * 8/2011 Mandel et al. ..... 270/58.01

FOREIGN PATENT DOCUMENTS

JP 10-139255 A 5/1998
JP 10-250914 A 9/1998
JP 2000-159418 A 6/2000
JP 2000159418 A * 6/2000
JP 2000-327208 A 11/2000
JP 2002-12358 A 1/2002
JP 2004-59268 A 2/2004

* cited by examiner

*Primary Examiner* — Patrick Mackey
(74) *Attorney, Agent, or Firm* — Holtz, Holtz, Goodman & Chick, PC

(57) ABSTRACT

Provided is a sheet ejection tray to which sheets are ejected; a stacker in which, after a plurality of sheets have been stacked, these sheets are ejected to the sheet ejection tray; a sheet ejection control section capable of controlling in such a way that it is selectable whether the sheets are ejected to the sheet ejection tray after having been stacked in the stack section, or the sheets are ejected to the sheet ejection tray without using the stack section; and an input button employed by an user to perform input operations. The sheet ejection control section provides control in such a way that, when the input button has been operated to perform an input operation while the sheets are ejected to the sheet ejection tray without using the stacker, the sheets will be ejected to the sheet ejection tray after having been stacked temporarily in the stacker.

16 Claims, 5 Drawing Sheets

POST-PROCESSING APPARATUS, SHEET EJECTION METHOD THEREOF AND IMAGE FORMING SYSTEM

This application is based on Japanese Patent Application No. 2009-107530 filed on Apr. 27, 2009 with Japanese Patent Office, the entire content of which is hereby incorporated by reference.

BACKGROUND OF THE INVENTION

The present invention relates to a post-processing apparatus, sheet ejection method thereof and image forming system.

One of the proposals having been made so far is a post-processing apparatus wherein, when a certain number of sheets have been ejected to a sheet ejection tray, the sheet ejection tray is lowered in response to it, and when the sheets on the sheet ejection tray have been removed, the lowered sheet ejection tray rises to the initial position. In this post-processing apparatus, the sheets are ejected to the staple tray arranged inside a post-processing apparatus to ensure that the sheets are not ejected to the upward traveling sheet ejection tray when printing operation is performed during the upward travel of the sheet ejection tray. After the upward travel of the sheet ejection tray, the sheets on the staple tray are ejected to the sheet ejection tray. If the sheets having been printed are ejected to the upward traveling sheet ejection tray, sheets might be put in disorder since the sheet ejection tray is moving upward. However, this arrangement prevents such a trouble (Japanese Unexamined Patent Application Publication No. Hei 10 (1998)-139255.

In an image forming apparatus having been proposed, buttons are provided to correspond to a plurality of sheet ejection trays, respectively, and the destination of the sheets is changed to the sheet ejection tray corresponding to the button having been pressed. During the operation, there may be the cases where sheets are stacked incorrectly on the sheet ejection tray and are misaligned to cause the ejected sheets being scattered due to some failure having occurred on the sheet ejection tray. If such a trouble occurs, however, in this image forming apparatus, the sheet ejection tray is changed by pressing the button. This operation prevents the sheets from being scattered, without the printing operation being stopped (Japanese Unexamined Patent Application Publication No. 2004-59268).

In the apparatus disclosed in the Japanese Unexamined Patent Application Publication No. Hei 10 (1998)-139255, if the sheets already stacked on the sheet ejection tray are to be removed during the printing operation, stacking failure or sheet jamming may occur due to the possible contact between the sheets to be removed and the sheets to be ejected.

In the case of the apparatus disclosed in the Japanese Unexamined Patent Application Publication No. 2004-59268, the sheet ejection tray as a destination of sheet ejection can be changed by pressing the button. Thus, if the sheet ejection tray as the destination of sheet ejection is changed, there is no possibility of contact between the sheets to be removed and the sheets to be ejected. Thus when removing the sheets stacked on the sheet ejection tray, there is no possibility of stacking failure or paper jamming. However, in the apparatus described in the Japanese Unexamined Patent Application Publication No. 2004-59268, sheets are ejected to a plurality of sheet ejection trays. Thus, the regularity of the pages may be lost when the user tries to rearrange the sheets having been removed, depending on how sheets are stacked. To put it more specifically, when the destination of sheets has been changed in the order of the sheet ejection tray 1, sheet ejection tray 2, and sheet ejection tray 3, the regularity of the pages will be lost if sheets are stacked by the user in the order of the sheet ejection tray 1, sheet ejection tray 3 and sheet ejection tray 2.

In the general post-processing apparatus, such post-processing operations as stapling and shifting can be performed only when sheets are ejected to the sheet ejection tray as a main ejection tray for the reason of mechanism. Thus, if the sheet ejection tray is changed as in the case of the Japanese Unexamined Patent Application Publication No. 2004-59268, the destination of sheet ejection may be changed from the main sheet ejection tray to the subsidiary sheet ejection tray. In this case, restrictions will be imposed on the post-processing function.

In view of the problems described above, it is an object of the present invention to provide a post-processing apparatus, sheet ejection method thereof and image forming system wherein, when sheets stacked on the sheet ejection tray are to be removed, the possibility for stacking failure or paper jamming is eliminated, page regularity is ensured, and restrictions are not imposed on post-processing functions.

SUMMARY

To achieve at least one of the abovementioned objects, a post-processing apparatus reflecting one aspect of the present invention comprises as follows.

1. A post-processing apparatus including a sheet ejection tray to which a sheet is ejected, a stack section which ejects one or more sheets to the sheet ejection tray after collecting the sheets therein, a sheet ejection control section which controls such that it is selectable whether to eject the one or more sheets to the sheet ejection tray after collecting the sheets in the stack section or to eject the sheets to the sheet ejection tray without using the stack section, and an input section which permits a user to perform an input operation, wherein the sheet ejection control section controls so as to repeat continuously a process including collecting the one or more sheets temporarily in the stack section and then ejecting the collected sheets to the sheet ejection tray, if an input operation is given to the input section while ejecting a sheet to the sheet ejection tray without using the stack section.

2. The post-processing apparatus of the above item 1, wherein the sheet ejection control section controls so as to eject the collected one or more sheets to the sheet ejection tray after collecting the sheets in the stack section for a first prescribed period of time, if an input operation is given to the input section while ejecting a sheet to the sheet ejection tray without using the stack section.

3. The post-processing apparatus of the above item 2, wherein the sheet ejection control section controls so as to repeat continuously the process until a second prescribed period of time longer than the first prescribed period of time has elapsed.

4. The post-processing apparatus of the above item 1, wherein the sheet ejection control section controls so as to eject the collected one or more sheets to the sheet ejection tray after collecting a first prescribed number of sheets, if an input operation is given to the input section while ejecting a sheet to the sheet ejection tray without using the stack section.

5. The post-processing apparatus of the above item 4, wherein the sheet ejection control section controls so as to repeat continuously the process until a second prescribed number of sheets greater than the first prescribed number of sheets have been supplied to the stack section.

6. The post-processing apparatus of the above item 1, wherein the sheet ejection control section controls so as to repeat continuously the process until the input operation is given again to the input section.

7. The post-processing apparatus of the above item 1, further including a removal detection sensor which detects removal of a sheet collected on the sheet ejection tray, wherein the sheet ejection control section controls so as to repeat continuously the process until the removal detection sensor detects removal of the sheet collected on the sheet ejection tray.

8. The post-processing apparatus of the above item 1, wherein the sheet ejection control section controls so as to repeat continuously the process and after ejecting the sheets to the sheet ejection tray, the sheet ejection control section controls so as to perform a process of ejecting a sheet to the sheet ejection tray without using the stack section.

9. The post-processing apparatus of the above item 1, wherein if an input operation is given to the input section while ejecting a sheet to the sheet ejection tray without using the stack section and if a plurality of sheets constitute one set of sheet bundle, the sheet ejection control section controls so as to eject a sheet to the sheet ejection tray without using the stack section until a separation of the set and to start collecting the sheets temporarily in the stack section from a first sheet of a new set.

10. The post-processing apparatus of the above item 1, wherein when the sheet ejection control section controls so as to repeat continuously the process and if a plurality of sheets constitute one set of sheet bundle, the sheet ejection control section controls so as to collect the sheets in the stacker until a separation of the set and eject the sheets collected until the separation of the set to the sheet ejection tray.

11. The post-processing apparatus of the above item 1, wherein the stack section is included in a post-processing section for post-processing a sheet.

12. The post-processing apparatus of the above item 1, further including a sheet standby section on an upstream side of the stack section to delay time when a sheet enters the stack section.

13. The post-processing apparatus of the above item 12, wherein the sheet standby section is an overlapping section which laps a next conveyed sheet over a standby sheet and then feeds the standby sheet and the next conveyed sheet lapped over each other to the stack section.

DETAILED DESCRIPTION OF THE PREFERRED EMBODIMENT

Figure 1:
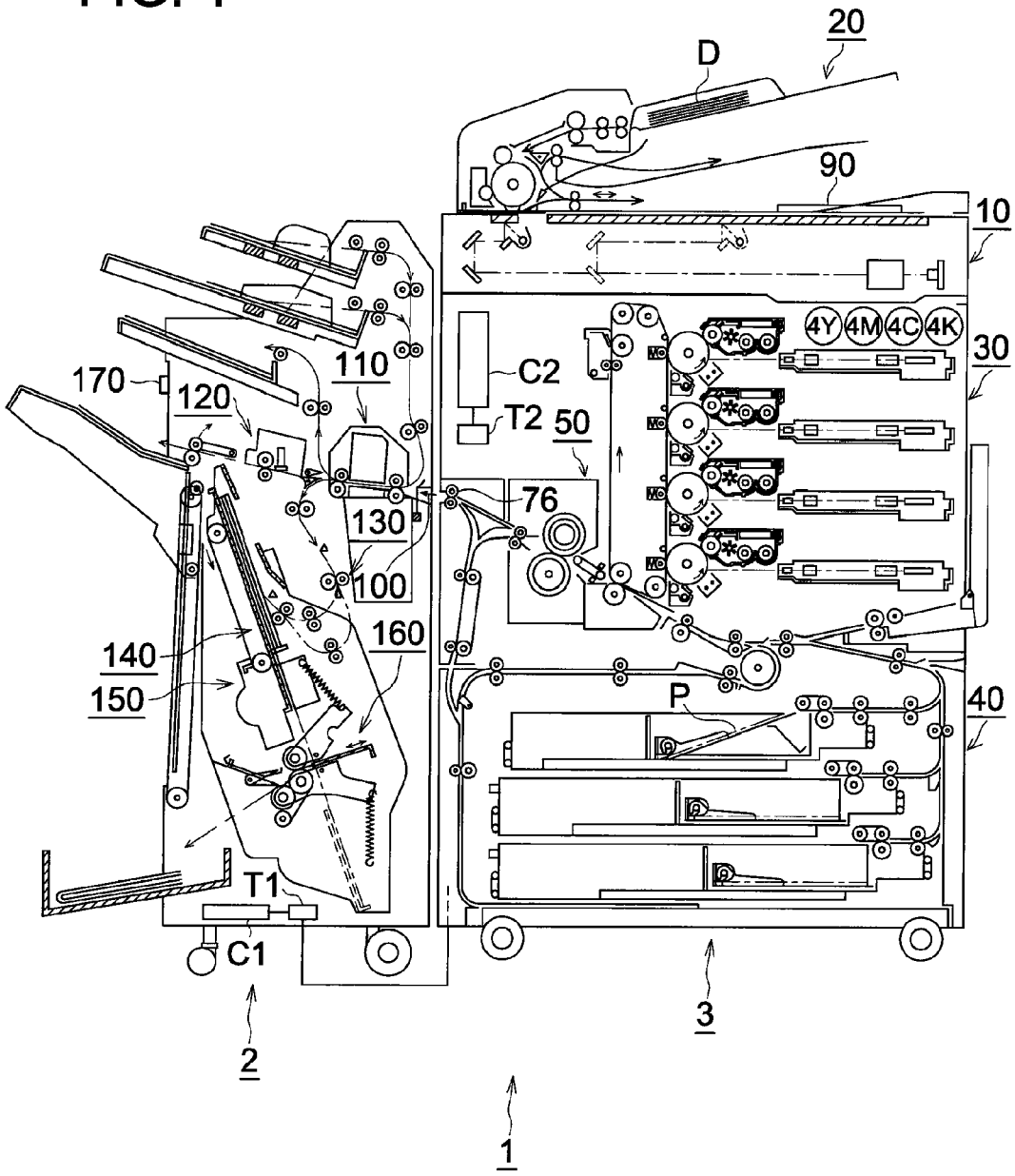
FIG. 1 is an overall schematic diagram of the image forming system including the post-processing apparatus of a present embodiment.

The abovementioned post-processing apparatuses of the embodiments bring about the following effects for example.

(A) If the input section is given an input operation while the sheets are ejected to the sheet ejection tray without using the stack section, the sheets are ejected to the sheet ejection tray after having been stacked temporarily in the stack section. This arrangement allows the user to remove the sheets stacked on the sheet ejection tray, while sheets are being stacked temporarily in the stack section, whereby the possibility of stacking failure or paper jamming is eliminated. Further, sheets are ejected to the same sheet ejection tray without the sheet ejection tray of the destination of sheet ejection being changed. This arrangement prevents the post-processing function from being restricted, without the destination of sheet ejection being changed to the subsidiary sheet ejection tray, when the sheet ejection tray of the destination of sheet ejection is the main sheet ejection tray. In addition, since the sheets are ejected to one sheet ejection tray, when the removed sheets are to be rearranged afterwards, complicated stacking procedures are not required, and hence page regularity can be easily maintained. Thus, when removing the sheets stacked on the sheet ejection tray, this arrangement eliminates the possibility of stacking failure or paper jamming, ensures easy retention of the page regularity and prevents the post-processing functions from being restricted.

(B) The operation of temporarily stacking the sheets in the stack section and ejecting the sheets to the sheet ejection tray is repeated until the second prescribed time longer than the prescribed time has elapsed. Thus, even after the lapse of the prescribed time, the operation of stacking the sheets in the stack section and ejecting the sheets is per formed on a continuous basis until the second prescribed time has elapsed. This arrangement provides the user with chances of removing the sheets several times, whereby easy sheet removal is ensured.

(C) The operation of temporarily stacking the sheets in the stack section and ejecting the sheets to the ejection tray is repeated until the second prescribed number of sheets greater than the prescribed number of the sheets have been supplied to the stack section. Thus, even if the prescribed number of sheets have been stacked in the stack section and ejected to the sheet ejection tray, the operation of stacking the sheets in the stack section and ejecting the sheets is performed on a continuous basis until the second prescribed number of sheets have been supplied to the stack section. This arrangement provides the user with chances of removing the sheets several times, whereby easy sheet removal is ensured.

(D) The operation of temporarily stacking the sheets in the stack section and ejecting the sheets to the sheet ejection tray is repeated until the input operation is performed again on the input section. Thus, the operation of stacking the sheets in the stack section and ejecting the sheets is performed on a continuous basis until the input operation is performed again on the input section. This arrangement provides the user with chances of removing the sheets several times, whereby easy sheet removal is ensured.

(E) The operation of temporarily stacking the sheets in the stack section is repeated. After the sheets are ejected to the sheet ejection tray, sheets are ejected to the sheet ejection tray without using the stack section. Thus, when it can be assumed that the user has removed the sheets stacked on the sheet ejection tray, the regular sheet ejecting operation is performed without using the stack section, whereby the original order is restored.

(F) If a plurality of sheets constitute one set, the sheet ejection control section preferably waits for the separation of the set, and stacks the sheets temporarily in the stack section, starting from the first sheet of a set. This eliminates the possibility of the sheets from the middle of the set being stacked in the stack section, and ensures the user to remove the sheets stacked on the sheet ejection tray at the separation of a set.

(G) The stack section constitutes a part of the post-processing section for post-processing the sheets. This arrangement reduces the number of components having the same functions.

(H) A sheet standby section is provided on the upstream side of the stack section to delay the time of sheets being fed to the stack section. When sheets are ejected from the stack section to the sheet ejection tray, this arrangement allows the time to be delayed until the sheets enter the stack section, and prevents the collision of sheets at the stack section.

(I) The sheet standby section is an overlapping section in such a way that, after the standby sheet and the incoming sheet have been placed on top of each other, these sheets are fed to the stack section. Thus, the overlapping section incorporated in the post-processing apparatus can be used to prevent collision of sheets in the stack section.

Further, other embodiments of the present invention are shown as follows.

A sheet ejection method of the post-processing apparatus including a sheet ejection tray to which a sheet is ejected and a stack section which ejects one or more sheets to the sheet ejection tray after collecting the sheets therein and an input section which permits a user to perform an input operation, the sheet ejection method including controlling sheet ejection so as to repeat continuously a process including collecting the one or more sheets temporarily in the stack section and then ejecting the collected sheets to the sheet ejection tray, if an input operation is given to the input section while a sheet is ejected to the sheet ejection tray without using the stack section.

An image forming system including (1) a post-processing apparatus having a sheet ejection tray to which a sheet is ejected, a stack section which ejects one or more sheets to the sheet ejection tray after collecting the sheets therein, and a sheet ejection control section which controls such that it is selectable whether to eject the one or more sheets to the sheet ejection tray after collecting the sheets in the stack section or to eject the sheets to the sheet ejection tray without using the stack section, and (2) an image forming apparatus having an input section which permits a user to perform an input operation, wherein the sheet ejection control section controls so as to repeat continuously a process including collecting the one or more sheets temporarily in the stack section and then ejecting the collected sheets to the sheet ejection tray, if an input operation is given to the input section while ejecting a sheet to the sheet ejection tray without using the stack section.

According to this sheet ejection method of the post-processing apparatus or this image forming system, if input operation has been performed on the input section while sheets are ejected to the sheet ejection tray without using the stack section, the sheets are ejected to the sheet ejection tray after having been stacked temporarily in the stack section. This arrangement allows the user to remove the sheets stacked on the sheet ejection tray while the sheets are being stacked temporarily in the stack section, whereby the possibility for stacking failure or paper jamming is eliminated. Further, sheets are ejected to the same sheet ejection tray without the sheet ejection tray of the destination of sheet ejection being changed. This arrangement prevents the post-processing function from being restricted, because the destination of sheet ejection is not changed to the subsidiary sheet ejection tray, when the sheet ejection tray of the destination of sheet ejection is the main sheet ejection tray. In addition, since the sheets are ejected to one and the same sheet ejection tray, when the removed sheets are to be rearranged afterwards, complicated stacking procedures are not required, page regularity can be easily maintained, and the post-processing functions can be prevented from being restricted.

The following describes the present invention based on the embodiments, without the present invention being restricted thereto. FIG. 1 is an overall structural diagram of the image forming system including the post-processing apparatus of the present embodiment. The image forming system 1 includes an image forming apparatus 3 and post-processing apparatus 2. In this image forming system 1, an image is formed of a sheet P by the image forming apparatus 3, and the sheet P with the image formed thereon is conveyed to the post-processing apparatus 2, wherein post-processing such as stapling is performed.

The image forming apparatus 3 includes a document image reading section 10 for reading a document image, an automatic document feed apparatus 20 for feeding the documents D, an image forming section 30 for forming an image according to the document image information captured by the document image reading section 10, a sheet feed section 40 for feeding sheets P to the image forming section 30, a fixing section 50 for fixing a toner image, an operation panel 90 having a display device and operation switches, and a control section C2 for controlling the aforementioned members.

The post-processing apparatus 2 includes a punching section 110 for punching the sheet P, a shifting section 120 for shifting the sheet P for each job, an accumulation section 130 acting as a sheet standby section for accumulating the sheets P temporarily, a stacker 140 for temporarily stacking the sheets P supplied from the accumulation section 130, a stapling section 150 for stapling a bundle of sheets P, a folding section 160 for folding the sheets P, and a control section C1 for providing overall control of the post-processing apparatus 2 and also serving as a sheet ejection control section for controlling sheet ejection. As will be described later, the control section C1 allows the mode for sheet ejection to be switched between the normal sheet ejection mode and stack mode. The post-processing section is made up of the punching section 110, shifting section 120, accumulation section 130, stacker 140, stapling section 150, and folding section 160.

In the image forming apparatus 3 and post-processing apparatus 2, the position and height of the ejection roller 76 of the image forming apparatus 3 and the receiving section 100 of the post-processing apparatus 2 are adjusted to ensure that the sheets P fed out of the image forming apparatus 3 can be received by the receiving section 100 of the post-processing apparatus 2. Then sheets P are fed to the receiving section 100 of the post-processing apparatus 2 through the ejection roller 76 of the image forming apparatus 3.

The image forming apparatus 3 and post-processing apparatus 2 includes the communication device T2 of the image forming apparatus 3, and the communication device T1 of the post-processing apparatus 2, respectively. Communication is carried out by the communication devices T1 and T2 to exchange information. For example, the communication device T2 of the image forming apparatus 3 sends information on post-processing operation. The post-processing apparatus 2 uses the communication device T1 to receive information on post-processing operation and conducts post-processing according to the received information on the post-processing. The details of the post-processing operation are set by the user using the operation panel 90.

Figure 2:
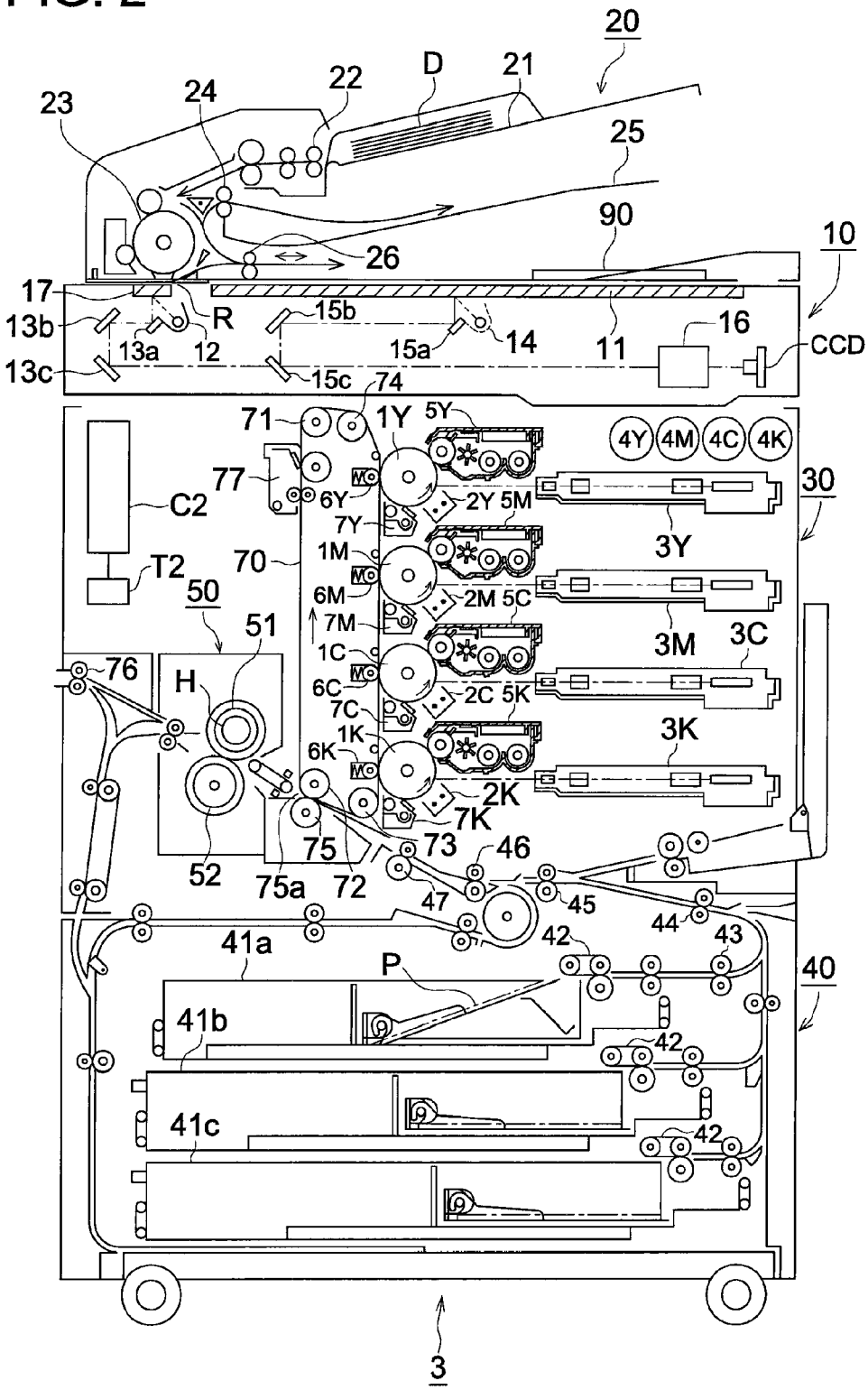
FIG. 2 is a structural diagram representing the details of the image forming system shown in FIG. 1.

FIG. 2 is a structural diagram showing the details of the image forming system 3 shown in FIG. 1. In FIG. 2, a tandem type full-color photocopier will be described as an example of the image forming apparatus.

As shown in FIG. 2, in the first place, the automatic document feed apparatus 20 includes a sheet feed tray 21, roller pair 22, conveyance drum 23, sheet ejection roller 24 and sheet ejection tray 25. The documents D stacked on the sheet feed tray 21 is separated from one another and is fed to the document reading area R. After that they are ejected to the sheet ejection tray 25. To put it more specifically, the documents D stacked on the sheet feed tray 21 are separated from one another and are fed by a vertically movable roller pair 22. The documents D are fed along the outer peripheral surface of a large-diameter conveyance drum 23 by the rotation of the conveyance drum 23 to reach the document reading area R. The document D having reached the document reading area R is ejected to the sheet ejection tray 25 by the sheet ejection roller 24.

Further, the document image reading section 10 includes platen glass 11, light sources 12 and 14, mirrors 13*a* through 13*c* and 15*a* through 15*c*, image forming lens 16, slit glass 17, and line image sensor CCD, and reads the images of the documents D conveyed by the automatic document feed apparatus 20 or the images of the documents D placed on the platen glass 11. When the document image reading section 10 reads the images of the documents D conveyed by the automatic document feed apparatus 20, the documents D conveyed through the document reading area R are illuminated by the light source 12 through the slit glass 17. The reflected light of the images of the documents D passes through the first through third mirrors 13*a* through 13*c* and image forming lens 16, and their images are formed on the line image sensor CCD. In the meantime, when reading the images of the documents D placed on the platen glass 11, the traveling light source 14 moves along the platen glass 11 below the platen glass 11. The reflected light of the images of documents D passes through the fourth through sixth mirrors 15*a* through 5*c* and the image forming lens 16, and their images are formed on the line image sensor CCD.

The line image sensor CCD converts the light of the document image into an analog signal. The analog signal is subjected to analog processing, analog-to-digital conversion, shading correction and image compression at an image processing section (not illustrated), and is turned into the digital image data of Y (yellow), M (magenta), C (cyan) and K (black).

The image forming section 30 includes drum-shaped photoreceptors 1Y, 1M, 1C and 1K, charging devices 2Y, 2M, 2C and 2K, exposure devices 3Y, 3M, 3C and 3K, toner supply devices 4Y, 4M, 4C and 4K, development devices 5Y, 5M, 5C and 5K, primary transfer rollers 6Y, 6M, 6C and 6K, cleaning devices 7Y, 7M, 7C and 7K, intermediate transfer body 70, roller 71 through 75, and cleaning device 77. An image is formed on the sheet P based on the image data obtained by the aforementioned image processing section.

The photoreceptors 1Y, 1M, 1C and 1K are the first image carriers corresponding to each of Y, C and K colors. The charging devices 2Y, 2M, 2C and 2K charge the photoreceptors 1Y, 1M, 1C and 1K corresponding to the Y, M C and K, respectively. The exposure devices 3Y, 3M, 3C and 3K form latent images on the corresponding photoreceptors 1Y, 1M, 1C and 1K based on the digital image data of each color.

The toner supply devices 4Y, 4M, 4C and 4K supply new toner. Toner of each color is supplied to the development devices 5Y, 5M, 5C and 5K. The development devices 5Y, 5M, 5C and 5K develop the latent image corresponding to each of the colors formed on the photoreceptors 1Y, 1M, 1C and 1K.

The development devices 5Y, 5M, 5C and 5K, and photoreceptors 1Y, 1M, 1C and 1K are arranged in a single line in the vertical direction. The intermediate transfer body 70 is a second endless image carrier rotatably applied to the rollers 71 through 74. Similarly to the development devices 5Y, 5M, 5C and 5K and photoreceptors 1Y, 1M, 1C and 1K, these intermediate transfer body 70 and rollers 71 through 74 are arranged in a single line on the side thereof. The intermediate transfer body 70 is driven through the roller 71 in the arrow-marked direction by the drive device (not illustrated) connected to the roller 71.

The primary transfer rollers 6Y, 6M, 6C and 6K are operated according to the type of image on a selective basis by the control section C2, and presses the intermediate transfer body 70 against the respective corresponding photoreceptors 1Y, 1M, 1C and 1K so that the toner images of different colors are sequentially transferred to the intermediate transfer body 70.

After the toner image has been transferred onto the intermediate transfer body 70 by the primary transfer rollers 6Y, 6M, 6C and 6K, the cleaning devices 7Y, 7M, 7C and 7K remove the toner remaining on the photoreceptors 1Y, 1M, 1C and 1K. The cleaning device 77 removes the toner remaining on the intermediate transfer body 70. The secondary transfer roller 75 ensures that the toner images superimposed on the intermediate transfer body 70 are collectively transferred onto the sheets P conveyed to the secondary transfer area 75*a*.

The sheet feed section 40 is provided with first through third sheet feed cassettes 41*a* through 41*c*, sheet feed unit 42, and various forms of rollers 43 through 47, and supplies sheets P to the image forming section 30. The first through third sheet feed cassettes 41*a* through 41*c* incorporate various forms of sheets P. The sheet feed unit 42 feeds the sheets P in the first through third sheet feed cassettes 41*a* through 41*c* one by one. A plurality of intermediate rollers 43 through 46 and registration roller 47 ensure that the sheets P having been fed by the sheet feed unit 42 are conveyed to the secondary transfer roller 75. The toner images superimposed on the intermediate transfer body 70 are collectively transferred onto the sheets P having been conveyed to the secondary transfer roller 75.

The fixing section 50 is provided with a heating roller 51 and pressure contact roller 52, and ensures that the toner image transferred onto the sheet P is fixed on the sheets P. To put it more specifically, the heating roller 51 incorporates a heating source H, and the pressure contact roller 52 applies pressure to the sheets P by sandwiching the sheets P with the heating roller 51. Heat and pressure are applied to the sheets P by these rollers 51 and 52, and the resin component of the toner is deposited, whereby toner image is fixed onto the sheets P.

The image forming apparatus 3 contains a sheet ejection roller 76. The sheets P subjected to fixing operation by the fixing section 50 are supplied to the post-processing apparatus 2 located downstream through an outlet.

Figure 3:
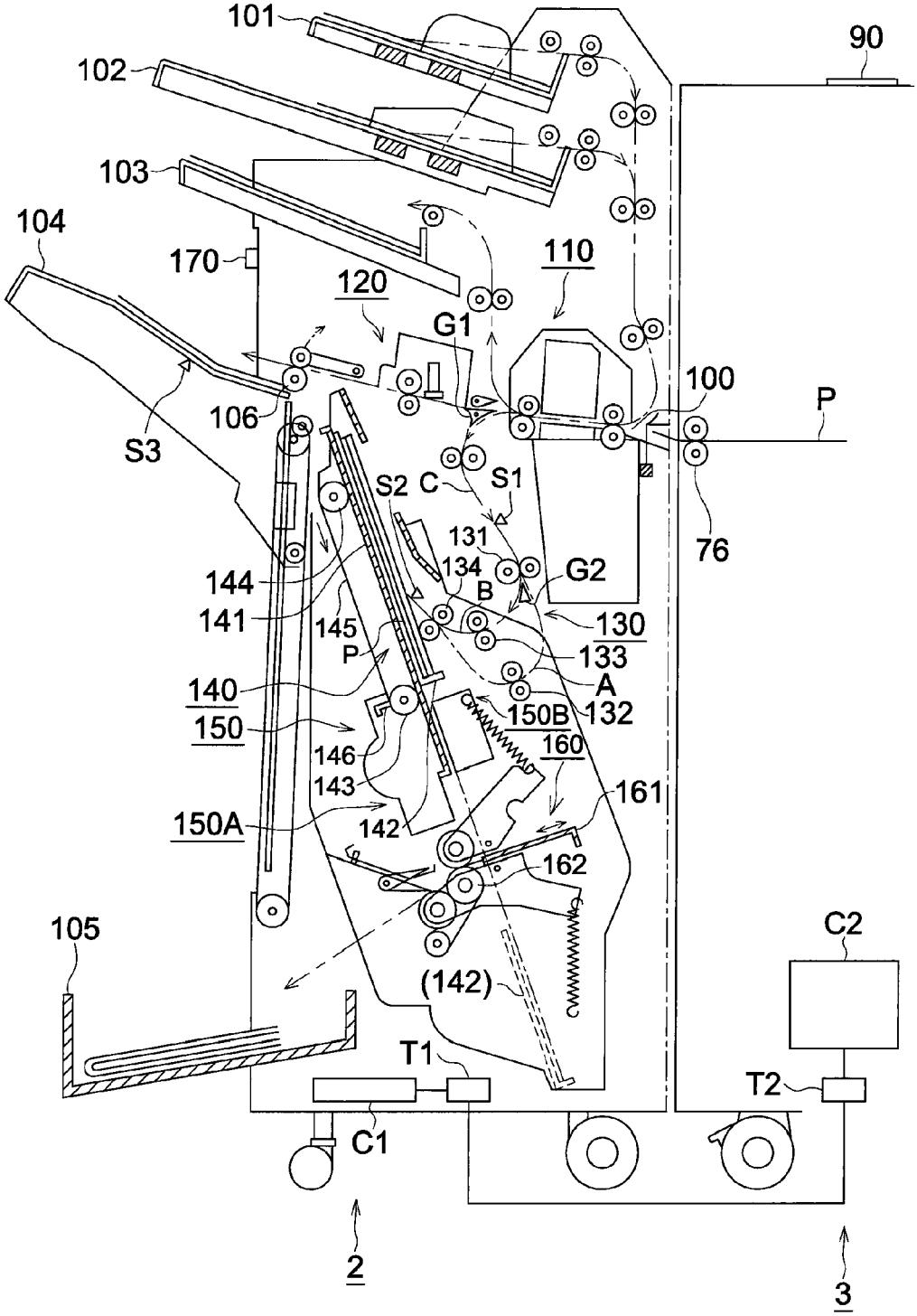
FIG. 3 is a structural diagram representing the details of the post-processing apparatus of FIG. 1.

FIG. 3 is a structural diagram representing the details of the post-processing apparatus 2 of FIG. 1. As shown in FIG. 3, the post-processing apparatus 2 is provided with sheet feed trays 101 and 102, and sheet ejection trays 103 through 105 in addition to the aforementioned punching section 110, shifting section 120, accumulation section 130, stacker 140, stapling section 150, folding section 160, and control section C1.

The sheet feed trays 101 and 102 are mounted on the upper level of the post-processing apparatus 2, and ensures that the sheets P placed thereon are supplied into the post-processing apparatus 2. The sheet ejection trays 103 through 105 are used to stack the sheets ejected from the post-processing apparatus 2. Further, the sheet ejection tray 103 is fixed in position, and the sheet ejection tray 104 is movable in the vertical direction to be used to stack the sheets P conveyed by the ejection roller 106. Sheets P having been center-folded by the folding section 160 are ejected to the sheet ejection tray 105.

When punching operation has been selected on the operation panel 90 of the image forming apparatus 3, the punching section 110 performs punching operation to the sheet P. The shifting section 120 applies the process of shifting in such a way that the sheets P conveyed when the first switching gate G1 is lowered are shifted in the direction perpendicular to the conveyance of the sheets P. Because of this process, the sheets P are shifted for each set.

Figure 4:
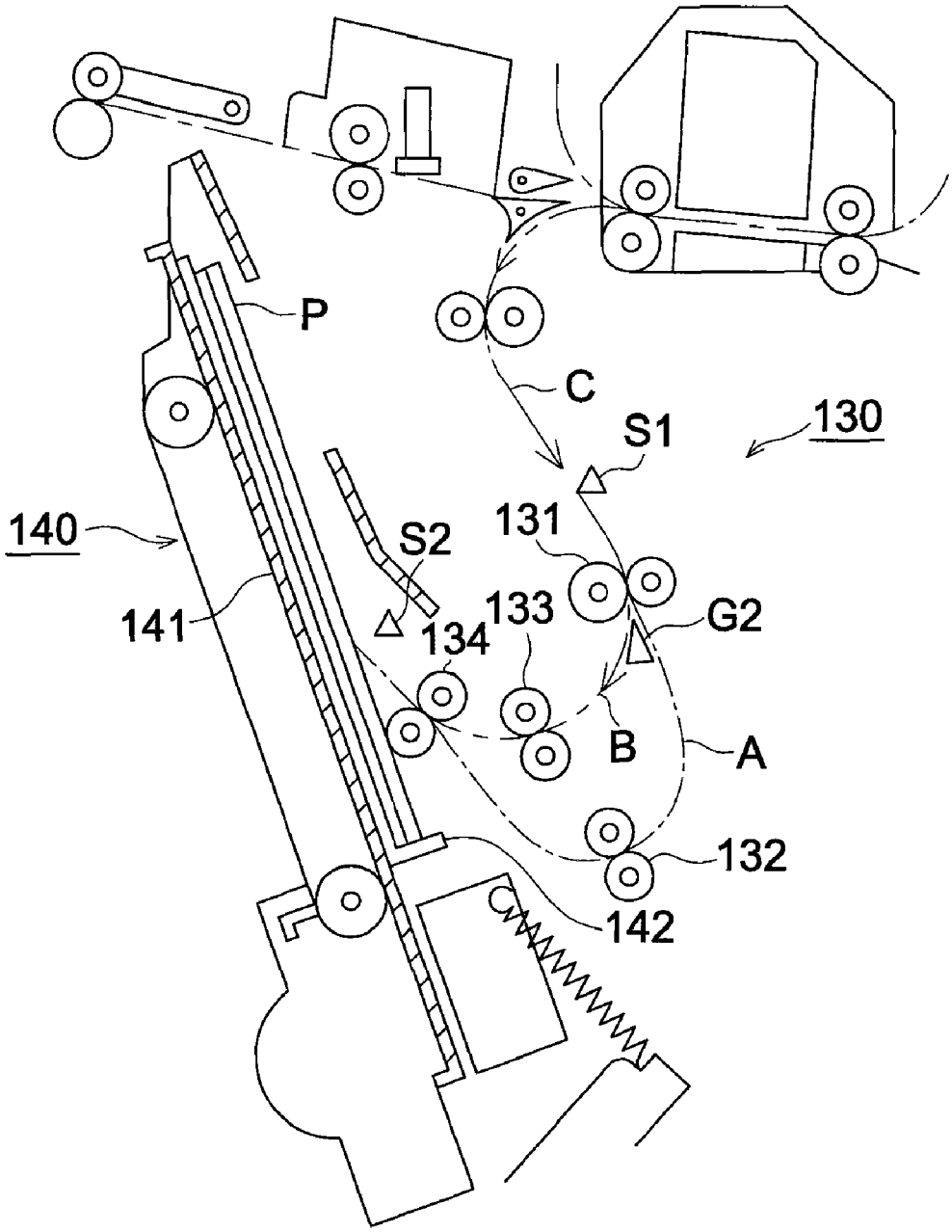
FIG. 4 is an enlarged view of the schematic diagram representing an example of the accumulation section.

The accumulation section 130 has two routes for conveying the sheets P. The sheets P are sent along each of these two routes, whereby sheets P are placed lapping over each other. FIG. 4 is an enlarged view of the structural diagram representing an example of the accumulation section 130. As shown in FIG. 4, the accumulation section 130 has two conveyance paths, a first conveyance path A and second conveyance path B. The sheets P conveyed when the first switching gate G1 is raised are received by the accumulation section 130 from the conveyance path C.

The accumulation section 130 includes various types of rollers 131 through 134 and ensures that the sheets P received from the conveyance path C are conveyed to the stacker 140 by these rollers 131 through 134. To put it more specifically, the accumulation section 130 is provided with a sensor S1 and second switching gate G2. The sheets P conveyed to the conveyance path C are detected by the sensor S1. When conveyance of the first sheet P has been detected by this sensor S1, the accumulation section 130 switches the second switching gate G2 so that the sheet P is supplied to the first conveyance path A. The accumulation section 130 allows the sheet P to be conveyed to the stacker 140 by the rollers 131, 132 and 134.

Further, when the conveyance of the second sheet P has been detected by the sensor S1, the accumulation section 130 switches the second switching gate G2 so that the sheet P is supplied to the second conveyance path B. The accumulation section 130 allows the sheets P to be conveyed to the stacker 140 by the rollers 131 through 133. The accumulation section 130 ensures that the first sheet P having been conveyed is placed on top of the second sheet P. In this case, the accumulation section 130 can use various forms of methods to place these sheets P lapping over each other. For example, in the case shown in FIG. 4, the conveyance distance of the first conveyance path A is longer than that of the second conveyance path B. The accumulation section 130 can take advantage of the difference in the conveyance distance to place the first sheet P and second sheet P on top of each other. Further, the accumulation section 130 can adjust the speed of rotation of the rollers 132 and 133 to put the first sheet P and second sheet P on top of each other. It should be noted that method of placing sheets P lapping over each other is not restricted to the ones shown above. Further, the sensor S1 is preferably a photoelectric sensor capable of non-contact detection of the sheets Pin order to eliminate the possibility of the conveyance of the sheet P being adversely affected.

Referring FIG. 3 again, the stacker 140 as a stack section ejects sheets P to the sheet ejection tray 104 after a plurality of sheets P have been stacked. The stacker 140 has an inclined chute 141 that forms an inclined surface, and holds the sheets P having been conveyed from the accumulation section 130. To be more specific, the sheet P having been conveyed from the accumulation section 130 falls under its own weight on the inclined chute 141 of the stacker 140 or the sheet P stacked on the inclined chute 141. Then the stacker 140 holds the sheet P having fallen.

The stacker 140 has a movable stopper 142, and holds the sheets P having fallen on the stacker 140 jointly with the inclined chute 141. The movable stopper 142 also serves to align the ends of the sheets P having been fallen under the own weight. The stacker 140 can be designed to include a roller, which ensures that the sheet P conveyed from the accumulation section 130 is biased toward the movable stopper 142 so that the ends of the sheets P are aligned with greater accuracy.

Further, the stacker 140 includes the rollers 143 and 144, endless belt 145 and hook section 146. One of the rollers 143 and 144 is a driving roller, while the other is a driven roller. The endless belt 145 is wound on these rollers 143 and 144, and is driven in conformance to the rotation of the rollers 143 and 144. The hook section 146 is a hook-shaped member mounted on the endless belt 145.

It moves in conformance to the rotation of the endless belt 145, and supports the lower ends of the sheets P stacked on the stacker 140, and guides the sheets P to the roller 106.

It should be noted that the stacker 140 has a sensor S2, and is capable of detect the number of sheets P stacked on the stacker 140.

The stapling section 150 staples a plurality of sheets P having been aligned by the movable stopper 142, and includes a stapling mechanism 150A and a staple receiving mechanism 150B. A paper feeding path is provided between the stapling mechanism 150A and staple receiving mechanism 150B to allow passage of the sheets P. When a plurality of sheets P have been stacked and aligned on the stacker 140, the stapling mechanism 150A and staple receiving mechanism 150B is biased by a drive device (not illustrated) to perform stapling operation.

The movable stopper 142 adjusts the position of the bundle of sheets P stacked on the stacker 140, and stops the bundle at a position corresponding to staple position of the stapling mechanism 150A.

The folding section 160 folds the bundle of sheets P stapled by the stapling section 150, and is provided with a push-in member 161 and rollers 162. This folding section 160 folds the bundle of the sheets P having been stapled and brought down to the folding position by the lowering motion of the movable stopper 142. To put it more specifically, the bundle of the sheets P lowered to the prescribed position is pushed in toward the rollers 162 by the push-in member 161. This procedure allows the bundle of sheets P to be folded so as to pass between the rollers 162, and the bundle of folded sheets P is then ejected to the sheet ejection tray 105.

The information on the post-processing processing to be applied is sent from the communication device T2 of the image forming apparatus 3 to the communication device T1 of the post-processing apparatus 2, and is identified by the control section C1. The control section C1 provides the overall control of the post-processing apparatus 2 and exchanges communications with the control section C2 of the image forming apparatus 3 through the communication device T1 of the post-processing apparatus 2 and the communication device T2 of the image forming apparatus 3.

Further, in this embodiment, the post-processing apparatus 2 is provided with an input button 170 serving as an input section. The input button 170 can be used by the user to perform input operations. This button is employed by the user to remove the sheets P stacked on the sheet ejection tray 104. By pressing the input button 170, the user can switch the mode from the normal sheet ejection mode where sheets P are ejected to the sheet ejection tray 104 on a continuous basis, to the stack mode wherein the sheets P are stacked on the stacker 140 by temporarily stopping the operation of ejecting the sheets P to the sheet ejection tray 104. Then the user is allowed to remove the sheets P during the stack mode.

To put it more specifically, assume that an instruction to form an image on a plurality of sheets P has been given through the operation panel 90 of the image forming apparatus 3. Also assume that the operation panel 90 has been operated to select the normal sheet ejection mode wherein sheets P are ejected to the sheet ejection tray 104 without using the stacker 140. In this case, the control section C1 received the aforementioned information through the communication device T1. The control section C1 controls the first switching gate G1 to ensure that the sheets P pass through the shifting section 120.

Further assume that the input button 170 has been pressed under this condition. Then the control section C1 detects that the input button 170 has been pressed. From the condition where the sheets P are ejected to the sheet ejection tray 104 without using the stacker 140, the mode is shifted to the stack mode wherein the sheets P are ejected to the sheet ejection tray 104 after having been stacked to the stacker 140 on a temporary basis.

To put it more specifically, when the mode is shifted to the stack mode, the control section C1 controls the first switching gate G1 in such a way that the sheets P are conveyed to the conveyance path C. The control section C1 allows the sheets P to be stacked on the stacker 140. While the sheets P are being stacked, the user is allowed to remove the sheets P stacked on the sheet ejection tray 104. After that, the stacker 140 ejects the stacked sheets P to the sheet ejection tray 104. Then, the control section C1 controls the first switching gate G1 to switch the mode to the normal sheet ejection mode wherein sheets P are ejected to the sheet ejection tray 104 without using the stacker 140.

The control section C1 can allow the sheets P to be stacked on the stacker 140 for a prescribed time or can allow a prescribed number of sheets P to be stacked on the stacker 140. In other words, the control section C1 can continue the stack mode for a prescribed time or until a prescribed number of sheets P have been stacked on the stacker 140. The prescribed time in the sense in which it is used here is 2 through 3 seconds, for example. It is preferably sufficient time for the user to remove the sheets P stacked on the sheet ejection tray 104. Further, the prescribed number of sheets P is preferably the number of the sheets P corresponding to 2 through 3 seconds of secured time, for example. It can be the number of sheets P to be shifted constituting one set, if the process of shifting has been selected on the operation panel 90.

Further, even if the sheets P have been stacked on the stacker 140 for the prescribed time or a prescribed number of sheets P have been stacked on the stacker 140, the user may lose the chance of removing the sheets P from the sheet ejection tray 104. Because of this, the control section C1 preferably repeats the operation of stacking the sheets P on the stacker 140 and ejecting them to the sheet ejection tray 104 until the second prescribed time longer than the prescribed time has elapsed or the second prescribed number of sheets P greater than the prescribed number of the sheets P have been supplied to the stacker 140. This arrangement will provide the user with a plurality of chances of removing the sheets P until the second prescribed time has elapsed or the second prescribed number of sheets P have been supplied to the stacker 140. This ensures easier removal of the sheets P. Further, it is also possible to make such arrangements that the control section C1 repeats the operation of stacking the sheets P on the stacker 140 until the input button 170 is pressed again. Still Further, as will be described later, it is also possible to make such arrangements that the control section C1 repeats the operation of stacking the sheets P on the stacker 140 until a removal detection sensor, which is provided to the sheet ejection tray 104, detects removal of the sheets P on the sheet ejection tray 104.

When the operation is repeated to stack the sheets P on the stacker 140 and to eject them to the sheet ejection tray 104 from the stacker 140, a new sheet P may be supplied to the stacker 140 before the sheets P on the stacker 140 have been completely removed. To solve this problem, the control section C1 preferably delays the time of the new sheet P being fed to the stacker 140 by the accumulation section 130, when the sheets P stacked on the stacker 140 are to be ejected to the sheet ejection tray 104. In this case, the control section C1 stops the operation of the rollers 132 and 133, or reduces the rotating speed of the rollers 132 and 133. Further, in the case where the sheets P are stacked temporarily on the stacker 140, when the sheets P are conveyed through the second conveyance path B, the control section C1 can be designed to allow the sheets P to be conveyed through the first conveyance path A, so that the distance of conveying the sheets P may be increased and the time of the sheets P entering the stacker 140 may be delayed.

Further, the accumulation section 130 has an overlapping function of placing the first sheet P on top of the second sheet P. Thus, the accumulation section 130 preferably places the first sheet P on top of the second sheet P so as to delay the time when the sheet P supplied to the stacker 140 enters the stacker 140. This arrangement ensures that the time of the sheet P entering the stacker 140 is delayed by the existing processing.

Further, the control section C1 preferably allows the sheets P to be stacked on the stacker 140 in units of the set. To be more specific, in the normal sheet ejection mode wherein sheets P are ejected to the sheet ejection tray 104 without using the stacker 140, if the user has pressed the input button 170 in the middle of the set of the sheets P, the control section C1 preferably waits for the separation of the set of the sheets P, and changes the mode to the stack mode wherein the sheets P are stacked to the stacker 140 starting from the first sheet of a new set.

Figure 5:
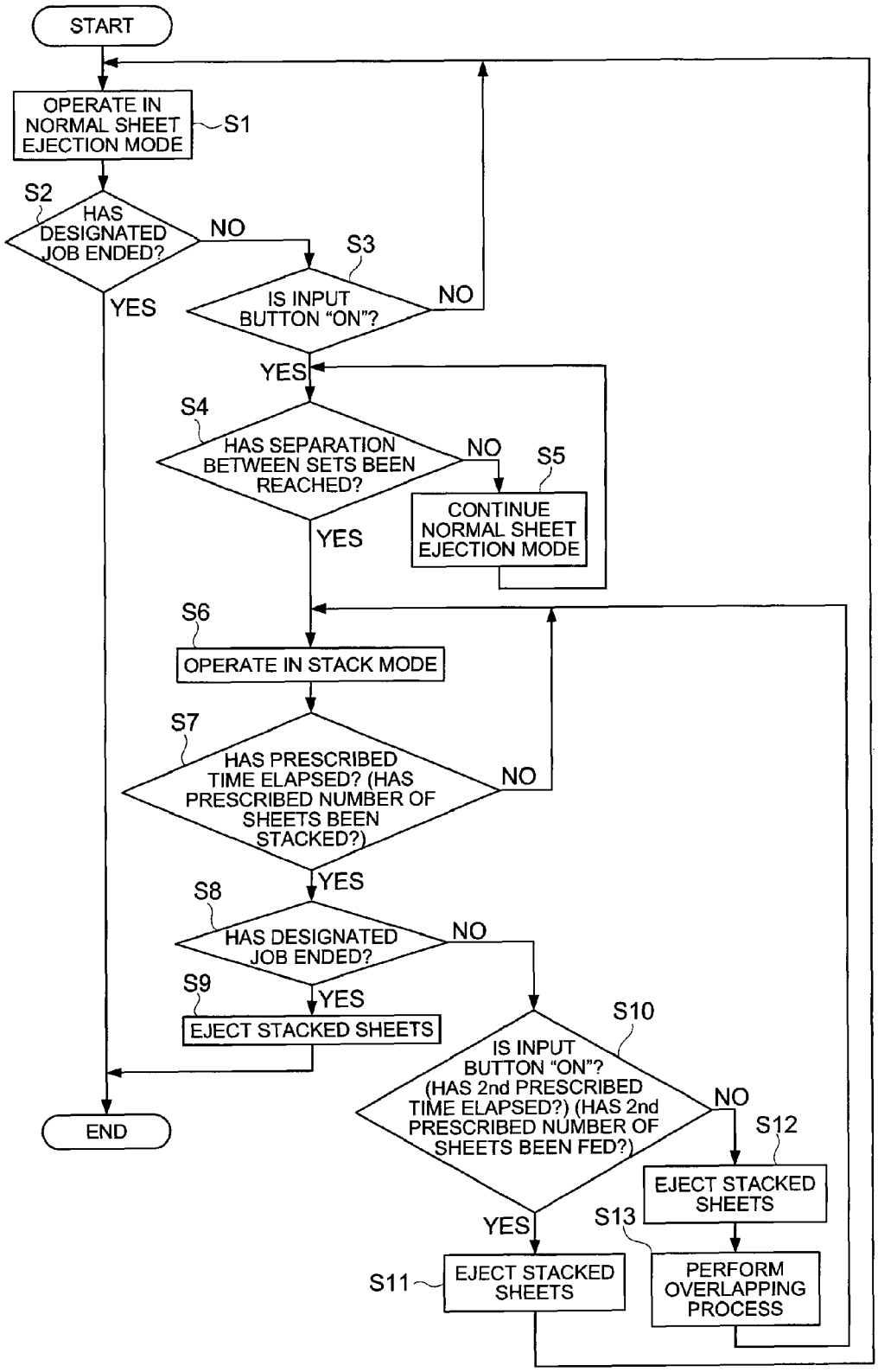
FIG. 5 is a flow chart representing the operation of the post-processing apparatus of a present embodiment.

Referring to a flow chart, the following describes the operations of the post-processing apparatus 2 of the present embodiment FIG. 5 is a flow chart representing the operation of the post-processing apparatus 2 of the present embodiment. As shown in FIG. 5, if a printing instruction is given from the operation panel 90 of the image forming apparatus 3, the post-processing apparatus 2 operates in the normal sheet ejection mode (S1). To be more specific, the control section C1 controls the first switching gate G1 so that the sheets P are conveyed to the shifting section 120. This arrangement allows the sheets P to be ejected to the sheet ejection tray 104 without using the stacker 140.

After that, the control section C1 determines if the designated job corresponding to the printing instruction given from the operation panel 90 has been terminated or not (S2). If a step is taken to determine that the designated job has been terminated (S2: YES), the processing of FIG. 5 terminates. In the meantime, if it has been determined that the designated job has not been terminated (S2: NO), the control section C1 determines if the input button 170 has been pressed or not (S3). If it has been determined that the input button 170 has not been pressed (S3: NO), processing goes to Step S1.

If it has been determined that the input button 170 has been pressed (S3: YES), the control section C1 determines whether or not the sheet P being ejected, when the input button 170 has been pressed, is the separation that separates the set of the sheets P (S4). If it has been determined that that sheet P is not the separation (S4: NO), the control section C1 maintains the normal sheet ejection mode (S5), and the processing goes to Step S4.

If it has been determined that the sheet P is the separation of the set (S4: YES), the post-processing apparatus 2 operates in the stack mode (S6). To be more specific, the control section C1 controls the first switching gate G1 so that the sheets P are conveyed to the conveyance path C, whereby the sheets P are supplied to the stacker 140. After that, the control section C1 determines if the prescribed time has elapsed or not after the start of operation in the stack mode (S7). In this processing, the control section C1 uses the timer built in the post-processing apparatus 2, and determines the prescribed time.

If it has been determined that the prescribed time has not elapsed after the start of the operation in the stack mode (S7: NO), the processing goes to Step S6. That is, the stack mode is maintained. If it has been determined that the prescribed time has elapsed after the start of the operation in the stack mode (S7: YES), the control section C1 determines if the designated job has terminated or not (S8).

In the processing of Step S7, it is also possible to make such arrangements that the control section C1 determines whether or not a prescribed number of the sheets P have been stacked on the stacker 140 after the start of the operation in the stack mode. The processing goes to Step S8 if it has been determined that a prescribed number of sheets P have been stacked on the stacker 140. The processing goes to Step S6 if it has been determined that a prescribed number of sheets P have not been stacked on the stacker 140. In this case, the control section C1 determines the number of the stacked sheets P according to the signal sent by the sensor S2.

If a plurality of sheets P constitute one set of sheets, in the processing of Step S7, the control section C1 can control to decide whether the processing goes to Step 8 or Step 6 by determining a separation of a set of sheets P being sent to the stacker 140 in the stack mode. In other words, for example, before the prescribed of period of time has elapsed or the prescribed number of sheets have been collected, if the sheet P being sent to the stacker 140 is determined to be the last sheet of a set, the processing goes to Step S8 (S7: YES) and if the sheet P being sent to the stacker 140 is determined not to be the last sheet of a set, the processing goes to Step S6 (S7: NO).

Because of this, when the number of sheets constituting the set is small, sheets can be ejected to the sheet ejection tray 104 in units of the set by giving priority to the separation of the set. Because the sheets are ejected to the sheet ejection tray in units of the set, the user can also handle the sheets in units of the set and when the removed sheets are to be rearranged afterwards, complicated stacking procedures are not required, and page regularity can be easily maintained, compared with the case where the sheets are separated in a middle part of the set. Further, when the user checks the performance of printing, the user can easily check in units of the set.

The selection among abovementioned determination whether the prescribed period of time has elapsed and determination whether the prescribed number of sheets have been collected in the stacker 140 and determination of separation of the set of sheets P can be established on the operating section such as the operation panel 90.

If it has been determined that the designated job has been terminated (58: YES), the control section C1 ensures that the sheets P stacked on the stacker 140 are ejected to the sheet ejection tray 104 (S9), and the processing of FIG. 5 terminates. If it has been determined that the designated job has not been terminated (S8: NO), the control section C1 determines whether or not the input button 170 has been pressed again (S10). If it has been determined that the input button 170 has been pressed again (S10: YES), the control section C1 ensures that the sheets P stacked on the stacker 140 are ejected to the sheet ejection tray 104 (S11), and the processing of FIG. 5 goes to Step S1. Namely, the post-processing apparatus 2 ejects sheets Pin the normal sheet ejection mode.

If it has been determined that the input button 170 has not been pressed again (S10: NO), the control section C1 ensures that the sheets P stacked on the stacker 140 are ejected to the sheet ejection tray 104 (S12). To avoid collision between the sheets P stacked on the stacker 140 to be ejected, and a new sheet P to be supplied to the stacker 140, the control section C1 performs the overlapping process (S13). In this process, the control section C1 ensures that the first sheet P is conveyed to the first conveyance path A, and the second sheet P is conveyed to the second conveyance path B. These sheets P are placed on top of the other. Then the processing goes to Step S6. That is to say, the stack mode is maintained.

Further, instead of the above input button 170, according to signals from a removal detection sensor S3 provided to the sheet ejection tray 104 (see FIG. 3), the control section C1 can determine whether to go to Step 11 or Step 12. In other words, if the removal detection sensor S3 detects that the sheets P ejected and collected have been removed from the sheet ejection tray 140, the control section C1 controls so that sheets P collected in the stacker 140 are ejected to the sheet ejection tray 104 (S11) and the processing goes to Step 1. To be more specific, the post-processing apparatus 2 ejects sheets in the normal sheet ejection mode. In the meantime, if the removal detection sensor S3 detects that the sheets P ejected and collected have not been removed from the sheet ejection tray 104, the control section C1 controls so that sheets P collected in the stacker 140 are ejected to the sheet ejection tray 104 (S12). Further, to avoid collision between the sheets P stacked on the stacker 140 to be ejected and the new sheets P to be supplied on the stacker 140, the control section C1 performs the overlapping process (S13).

Because of this, in addition to the effects in the case where the input button 170 is used, reduction of labor and quicker response actions of the apparatus are possible, whereby enhancement of the workability and productivity can be obtained.

Regarding the removal detection sensor S3 provided on the sheet ejection tray 104, sensors of an optical detection type or a weight detection type or others can be used Concerning the detection method, both of a removal of all the sheets on the sheet ejection tray and a partial sheet removal can be detected and because of this, the setting of apparatus movement according to the detection method is also possible.

It is also possible to make such arrangements in the process of Step S10 that the control section C1 determines whether or not the second prescribed time longer than the prescribed time has elapsed. The processing goes to Step S12 when the control section C1 has determined that the second prescribed time has elapsed. The processing goes to Step S11 when the control section C1 has determined that the second prescribed time has not elapsed. In this case, the control section C1 uses the built-in timer to determine the lapse of the second prescribed time, similarly to the case of Step S7.

When determining whether or not a prescribed number of sheets P have been stacked in the process of Step S7, the control section C1 can be designed to determine whether or not the second prescribed number of sheets P greater than the prescribed number of sheets P have been supplied to the stacker 140. The processing goes to Step S11 if the control section C1 determines that the second prescribed number of sheets P have been supplied to the stacker 140. The processing goes to Step S12 if the control section C1 determines that the second prescribed number of sheets P have not been supplied to the stacker 140. In this case, the control section C1 uses the signal of the sensor S2 to determine whether or not the second prescribed number of sheets P have been supplied, similarly to the case of Step S7.

As described above, according to the post-processing apparatus 2 and sheet ejection method thereof in the present embodiment, if an input operation has been performed on the input button 170 during the ejection of the sheets P to the sheet ejection fray 104 without using the stacker 140, the sheets P are ejected to the sheet ejection tray 104 after the sheets P have been temporarily stacked on the stacker 140. This arrangement allows the user to remove the sheets P stacked on the sheet ejection tray 104 while the sheets P are being stacked on the stacker 140 temporarily, whereby the possibility of stacking failure or paper jamming is eliminated. Further, sheets P are ejected to the same sheet ejection tray without the sheet ejection tray of the destination of sheet ejection being changed. This arrangement prevents the post-processing function from being restricted, because the destination of sheet ejection is not changed to the subsidiary sheet ejection trays 103 and 105, when the sheet ejection tray of the destination of sheet ejection is the main sheet ejection tray 140. In addition, since the sheets are ejected to one sheet ejection tray, when the removed sheets are to be rearranged afterwards, complicated stacking procedures are not required, and page regularity can be easily maintained. Thus, when removing the sheets P stacked on the sheet ejection tray 104, this arrangement eliminates the possibility of stacking failure or paper jamming. At the same time, page regularity can be easily maintained, and the post-processing functions can be prevented from being restricted.

The details of page regularity will be described. The following differences can be found between the apparatus described in Japanese Unexamined Patent Application Publication No. 2004-59268, and the post-processing apparatus 2 and sheet ejection method thereof in the present embodiment. For example, in the apparatus described in Japanese Unexamined Patent Application Publication No. 2004-59268, when the destination of sheet ejection has been changed in the order of sheet ejection tray 1, sheet ejection tray 2 and sheet ejection tray 3, the page regularity will be lost if the user places sheets on top of another in the order of the sheet ejection tray 1, sheet ejection tray 3 and sheet ejection tray 2. By contrast, in the post-processing apparatus 2 and sheet ejection method thereof in the present embodiment, sheets P are continually ejected to the same sheet ejection tray 104. Thus, the user need not memorize the order of the change in the sheet ejection trays. The user is only required to remove the sheets P ejected on the sheet ejection tray 104 and to stack them. Then, page regularity is maintained.

The operation of temporarily stacking the sheets P on the stacker 140 and ejecting sheets P to the sheet ejection tray 104 is repeated until the second prescribed time longer than the prescribed time has elapsed. Thus, even when the prescribed time has elapsed, stacking of the sheets P to the stacker 140 and ejection of these sheets P are performed on a continuous basis before the second prescribed time elapses. This provides the user with a plurality of chances of removing the sheets P, and ensures easier removal of the sheets P.

Further, the operation of temporarily stacking the sheets P on the stacker 140 and ejecting sheets P to the sheet ejection tray 104 is repeated until the second prescribed number of sheets P greater than the prescribed number of the sheets P have been supplied to the stacker 140. Even if the prescribed number of the sheets P have been stacked on the stacker 140 and ejected to the stacker 140, the operation of stacking the sheets P on the stacker 140 and ejecting these sheets P is performed on a continuous basis until the second prescribed number of sheets P have been supplied to the stacker 140. This arrangement provides the user with a plurality of chances of removing the sheets P and ensures easier removal of the sheets P.

The operation of temporarily stacking the sheets P on the stacker 140 and ejecting the sheets P to the sheet ejection tray 104 is repeated until the input operation is again performed on the input button 170. Since the operation of stacking the sheets P on the stacker 140 and ejecting the sheets P is performed on a continuous basis until the input operation is again performed on the input button 170, the user is provided with a plurality of chances of removing the sheets P, whereby easier removal of the sheets P is ensured.

The operation of temporarily stacking the sheets P on the stacker 140 is repeated. After ejection of the sheets P to the sheet ejection tray 104, the sheets P are ejected to the sheet ejection tray 104 without using the stacker 140. Thus, when it has been estimated that the user has already removed the sheets P stacked on the sheet ejection tray 104, the normal sheet ejection of the sheets P is performed without using the stacker 140. This arrangement allows the original order to be recovered.

If a plurality of sheets P constitute one set, the system waits for the separation of that set, and stacks the sheets P temporarily on the stacker 140, starting from the first sheet of a new set. This eliminates the possibility of the sheets Pin the middle of the set being stacked in the stack section, and ensures the user to remove the sheets P stacked on the sheet ejection tray 140 at the separation of a set.

The stacker 140 is a post-processing section for performing post-processing operation of the sheets P. This structure reduces the number of parts sharing the functions.

Further, an accumulation section 130 as a sheet standby section for delaying the time of the sheets P being conveyed to the stacker is provided on the upstream side of the stacker 140. When sheets P are ejected from the stack section 140 to the sheet ejection tray 104, this arrangement allows the time when a sheet P enters the stacker 140 to be delayed, and prevents the collision of sheets P at the stacker 140.

The accumulation section 130 is an overlapping section wherein, after the standby sheet P and the next sheet P to be conveyed have been placed on top of the other, these sheets P are conveyed to the stacker 140. The overlapping section built in the post-processing apparatus can be employed to prevent the collision of the sheets P at the stacker 140.

The post-processing apparatus of the present invention has been described with reference to embodiments. It is to be expressly understood, however, that the present invention is not restricted thereto. The present invention can be embodied in a great number of variations with appropriate modification or additions, without departing from the spirit and scope of the invention claimed.

For example, in the aforementioned embodiment, when the input button 170 has been pressed, the mode of the post-processing apparatus 2 changes from the normal sheet ejection mode to the stack mode. Without the present invention being restricted thereto, the same functions can be implemented by the operation panel 90 by omitting the structure of the input button 170. In this case, the user is allowed to change the mode of the post-processing apparatus 2 from the normal sheet ejection mode to the stack mode by performing the prescribed operation on the operation panel 90. Further, the post-processing apparatus 2 can be restored to the normal sheet ejection mode from the stack mode by performing the prescribed operation again on the operation panel 90.

The post-processing apparatus connected to a digital color photocopier has been used to describe the aforementioned embodiment. Without the present invention being restricted thereto, this post-processing apparatus can be connected to other image forming apparatus such as a multi-functional peripheral.

As described above, according to the embodiments of the present invention, when the sheets stacked on the sheet ejection tray are removed, the possibility of stack failure or paper jamming can be eliminated. At the same time, page regularity can be easily maintained, and the post-processing functions can be prevented from being restricted.

What is claimed is:

1. A post-processing apparatus comprising:

a sheet ejection tray to which a sheet is ejected;

a stack section which ejects one or more sheets to the sheet ejection tray after collecting the one or more sheets therein;

a sheet ejection control section which is controllable to select whether to eject the one or more sheets to the sheet ejection tray after collecting the one or more sheets in the stack section or to eject the one or more sheets to the sheet ejection tray without using the stack section; and an input section which accepts an input operation by a user;

wherein the sheet ejection control section controls so as to repeat continuously until a designated job ends, a process including collecting the one or more sheets temporarily in the stack section until one of a prescribed period of time has elapsed and a prescribed number of sheets have been collected, and then to eject the collected sheets to the sheet ejection tray, when an input operation is accepted by the input section while ejecting a sheet to the sheet ejection tray without using the stack section.

2. The post-processing apparatus of claim 1, wherein the sheet ejection control section controls so as to continuously repeat the process until a second input operation is accepted by the input section.

3. The post-processing apparatus of claim 1, further comprising:

a detection sensor which detects a sheet collected on the sheet ejection tray, wherein the sheet ejection control section controls so as to continuously repeat the process until the detection sensor detects a prescribed condition of the sheet collected on the sheet ejection tray.

4. The post-processing apparatus of claim 1, wherein the sheet ejection control section controls so as to continuously repeat the process and, after ejecting the one or more sheets to the sheet ejection tray, the sheet ejection control section controls so as to perform a process of ejecting a sheet to the sheet ejection tray without using the stack section.

5. The post-processing apparatus of claim 1, wherein when an input operation is received at the input section while a sheet is being ejected to the sheet ejection tray without using the stack section and when a plurality of sheets constitute one set of a sheet bundle, the sheet ejection control section controls so as to eject a sheet to the sheet ejection tray without using the stack section until a separation of the set occurs and to start collecting the sheets temporarily in the stack section from a first sheet of a new set.

6. The post-processing apparatus of claim 1, wherein when the sheet ejection control section controls so as to continuously repeat the process and when a plurality of sheets constitute one set of a sheet bundle, the sheet ejection control section controls so as to collect the sheets in the stack section until a separation of the set and eject the collected sheets until the separation of the set to the sheet ejection tray.

7. The post-processing apparatus of claim 1, wherein the stack section is provided in a post-processing section for post-processing a sheet.

8. The post-processing apparatus of claim 1, further comprising:

a sheet standby section provided on an upstream side of the stack section to delay a time at which a sheet enters the stack section.

9. The post-processing apparatus of claim 8, wherein the sheet standby section comprises an overlapping section which overlaps a next conveyed sheet over a standby sheet and then feeds the standby sheet and the next conveyed sheet which are overlapped to the stack section.

10. The post-processing apparatus of claim 1, further comprising:

a designation section for designating a time or a total number of sheets from a start of a repetition of the process until an end of a repetition of the process, wherein, when one of the designated time has elapsed and a total number of sheets which have been supplied to the stack section reaches the designated total number of sheets, the sheet ejection control section stops the repetition of the process.

11. A sheet ejection method of a post processing apparatus including a sheet ejection tray to which a sheet is ejected, a stack section which ejects one or more sheets to the sheet ejection tray after collecting the one or more sheets therein, and an input section which accepts an input operation by a user, the sheet ejection method comprising:

controlling sheet ejection so as to repeat continuously until a designated job ends, a process including collecting the one or more sheets temporarily in the stack section until one of a prescribed period of time has elapsed and a prescribed number of sheets have been collected, and then to eject the collected sheets to the sheet ejection tray, when an input operation accepted by the input section while a sheet is ejected to the sheet ejection tray without using the stack section.

12. The sheet ejection method of claim 11, further comprising:

designating a time or a total number of sheets from a start of a repetition of the process until an end of a repetition of the process, and stopping the repetition of the process when one of the designated time has elapsed and a total number of sheets which have been supplied to the stack section reaches the designated total number of sheets.

13. An image forming system comprising:

a post-processing apparatus comprising:

a sheet ejection tray to which a sheet is ejected;

a stack section which ejects one or more sheets to the sheet ejection tray after collecting the one or more sheets therein; and a sheet ejection control section which is controllable to select whether to eject the one or more sheets to the sheet ejection tray after collecting the one or more sheets in the stack section or to eject the one or more sheets to the sheet ejection tray without using the stack section; and an image forming apparatus comprising:

an input section which accepts an input operation by a user;

wherein the sheet ejection control section controls so as to repeat continuously until a designated job ends, a process including collecting the one or more sheets temporarily in the stack section until one of a prescribed period of time has elapsed and a prescribed number of sheets have been collected, and then to eject the collected sheets to the sheet ejection tray, when an input operation is given to the input section while ejecting a sheet to the sheet ejection tray without using the stack section.

14. The image forming system of claim 13, further comprising:

a designation section for designating one of a time and a total number of sheets from a start of a repetition of the process until an end of a repetition of the process, wherein, when one of the designated time has elapsed and a total number of sheets which have been supplied to the stack section reaches the designated total number of sheets, the sheet ejection control section stops the repetition of the process.

15. A post-processing apparatus comprising:

a sheet ejection tray to which a sheet is ejected;

a stack section which ejects one or more sheets to the sheet ejection tray after collecting the one or more sheets therein;

a sheet ejection control section which is controllable to select whether to eject the one or more sheets to the sheet ejection tray after collecting the one or more sheets in the stack section or to eject the one or more sheets to the sheet ejection tray without using the stack section; and an input section which accepts an input operation by a user; and a detection sensor which detects a sheet on the sheet ejection tray;

wherein the sheet ejection control section controls so as to repeat continuously a process including collecting the one or more sheets temporarily in the stack section and then ejecting the collected sheets to the sheet ejection tray, until one of a second input operation is accepted by the input section and the detection sensor detects a prescribed condition of the sheet collected on the sheet ejection tray, when a first input operation is accepted by the input section while ejecting a sheet to the sheet ejection tray without using the stack section.

16. A sheet ejection method for a post-processing apparatus including a sheet ejection tray to which a sheet is ejected, a stack section which ejects one or more sheets to the sheet ejection tray after collecting the one or more sheets therein, an input section which accepts an input operation by a user, and a detection sensor which detects a sheet collected on the sheet ejection tray, the sheet ejection method comprising:

controlling sheet ejection so as to repeat continuously a process including collecting the one or more sheets temporarily in the stack section and then ejecting the collected sheets to the sheet ejection tray, until one of a second input operation is accepted by the input section and the detection sensor detects a prescribed condition of the sheet collected on the sheet ejection tray, when a first input operation is accepted by the input section while a sheet is ejected to the sheet ejection tray without using the stack section.

* * * * *